United States Patent [19]

Craveiro

[11] Patent Number: 5,002,508

[45] Date of Patent: Mar. 26, 1991

[54] MULTIPLE BATTERY TERMINAL CONNECTOR

[75] Inventor: Joseph C. Craveiro, Costa Mesa, Calif.

[73] Assignee: American Consolidated Enterprises, Inc., Costa Mesa, Calif.

[21] Appl. No.: 401,943

[22] Filed: Sep. 1, 1989

[51] Int. Cl.[5] ..... H01R 11/24

[52] U.S. Cl. ..... 439/755; 439/759

[58] Field of Search ..... 439/504, 754, 755, 759, 439/909, 828, 829

[56] References Cited

U.S. PATENT DOCUMENTS

| | | | |
|---|---|---|---|
| 3,745,516 | 7/1973 | Lieberman | 439/755 |
| 3,783,439 | 1/1974 | Valentino | 439/755 |
| 4,072,388 | 2/1978 | Dunn | 439/829 |
| 4,345,807 | 8/1982 | Shekel et al. | 439/755 |
| 4,377,317 | 3/1983 | Shekel et al. | 439/755 |
| 4,429,944 | 2/1984 | Bell | 439/759 |
| 4,620,767 | 11/1986 | Woolf | 439/755 |
| 4,826,457 | 5/1989 | Varatta | 439/755 |
| 4,854,901 | 8/1989 | Vernachio | 439/755 |

*Primary Examiner*—Gary F. Paumen

*Attorney, Agent, or Firm*—Klein & Szekeres

[57] ABSTRACT

A battery cable connector is disclosed for connecting to batteries that have a side terminal, as well as for batteries that have a top terminal. The invention provides for connection to either types of batteries without any further modification of the battery cable connector. Two sets of openings within the conductive portion of the battery connector cable enable easy attachment to either a side mounted battery terminal or a top mounted battery terminal without further reconfiguration of the battery cable connector.

17 Claims, 4 Drawing Sheets

MULTIPLE BATTERY TERMINAL CONNECTOR

BACKGROUND OF THE INVENTION

1. Field of the Invention

The present invention is directed to an improved battery connector that can be used either for top mounted battery terminals or for side mounted battery terminals and, more particularly, to a battery connector that can be secured to any battery terminal while preventing slippage after it is secured to the battery terminal.

2. Description of Related Art

The increased use of both side and top mounted battery terminals in the automotive industry has created a demand for a relatively inexpensive and reliable battery connector that can be used for both side and top mounted battery terminals. Numerous types of battery connectors have been proposed; however, they are generally of the kind that requires some form of adjustment in order to be able to be used with either side mounted terminal batteries or top mounted terminal batteries. There has been a continued demand in the automotive field to provide a battery connector that will be effective for both side mounted terminal batteries and top mounted terminal batteries without adjustments to the battery connector prior to use.

U.S. Pat. No. 3,745,516 discloses an auxiliary clamp for side mounted battery terminals. The auxiliary clamp is a mechanism that attaches to a battery connector to enable battery connectors to attach to side mounted battery terminals. U.S. Pat. No. 3,783,439 similarly discloses adaptors for connecting to a side mounted battery terminal. U.S. Pat. No. 4,377,317 discloses a side mounted battery terminal adaptor for connecting the cables to a side terminal of a battery terminal.

U.S. Pat. No. 4,345,807 discloses a battery cable connector for top and side mounted battery terminals. This battery connector has a side mounted battery terminal clamp which is connected to a support member which is pivotally mounted to the end portion and can be moved into place to enable the connector to be usable with side mounted battery terminals. U.S. Pat. No. 4,620,767 discloses a combination battery booster cable connector for both side and top mounted terminal batteries. The connector has portions extending forward from the jaws to enable the engagement of the side terminal bolt of a side mounted battery terminal.

The automotive industry is still seeking to find an economical and reliable means to secure battery cables to both side and top mounted battery terminals without adjustments to the connector for one type of battery terminal or another. Preventing the battery cable connector from slipping from the terminal of a side mounted terminal battery once it is in place remains a problem in the prior art.

SUMMARY OF THE INVENTION

The present invention is directed towards a battery cable connector for the attachment of terminals on both side and top mounted batteries. The body member has two legs which are mounted pivotally with spring biasing. Insulating members are provided on the legs for contact with the human hand, and the conductive portions of the legs are used for connection to battery terminals. The conductive portions of the legs have, on one side, a circular opening with which to attach to side terminals of side mounted terminal batteries. The opposite side of the conductive portions have a plurality of teeth with which to attach to top terminals of top mounted terminal batteries.

The features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

DESCRIPTION OF THE PREFERRED EMBODIMENTS

The following description is provided to enable any person skilled in the automotive industry to make and use the invention and sets forth the best modes contemplated by the inventor of carrying out his invention. Various modifications, however, will remain readily apparent to those skilled in the arts since the generic principles of the present invention have been defined herein specifically to provide a relatively easily manufactured battery terminal connector for use with vehicle electrical systems.

Figure 1:
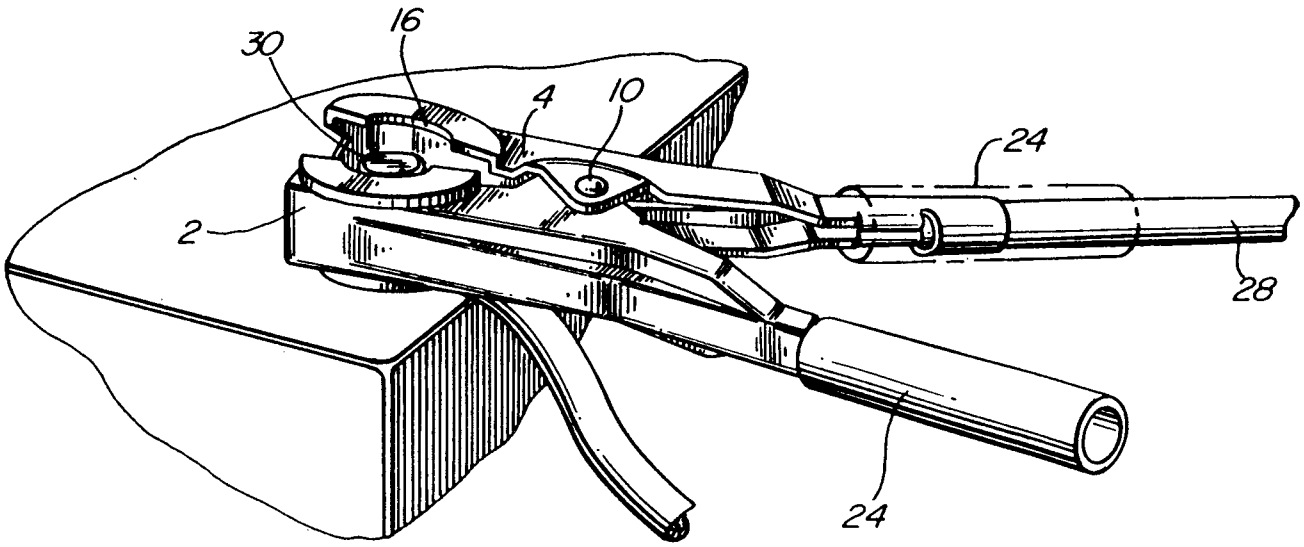
FIG. 1 is a perspective view of the battery cable connector according to the invention showing it engaged to the terminal of a top battery terminal.

Referring to FIG. 1, the invention is seen in a perspective view as it would normally operate for a top mounted terminal battery. As can be seen, the battery connector is comprised essentially of a first leg 4 and a second leg 2. At the left side of the legs, as shown in FIG. 1, are the first ends of the legs. These first ends contain apertures which are used to attach to battery terminals. Preferably, the legs are constructed of a copper alloy or some other rigid metallic material. The two legs are connected by a rivet 10 about which they rotate. The terminal post 30 is placed in the aperture at the first end of the opened legs when the insulating portion 24 of the connector handles 24 are squeezed together, thus rotating the legs about the rivet 10. Releasing the insulating handles 24 enables attachment to the battery terminal 30.

Figure 2:
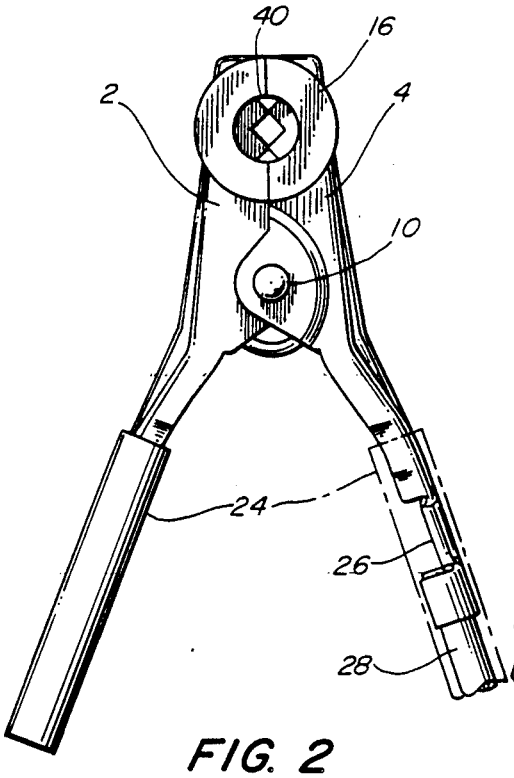
FIG. 2 is a top view of the battery cable connector having a circular opening for connection to side battery terminals.

FIG. 2 shows an annular ring 16, used to form a circular aperture to attach the connector to batteries with side mounted terminals. The circular aperture is formed by the cooperative meeting of a semiannular ring extending from each leg and integrally stamp molded into each such that a circular aperture is formed, surrounded by the semiannular ring stamp molded into the top side of each of the legs. The annular ring is raised above the rest of the connector and offsets the remainder of the connector from the battery. Here it can be seen that by squeezing the insulating handles 24, the circular aperture 40 is opened to enable attachment to the terminals used for batteries located on the side of the battery. The two legs 2, 4 will pivot around the rivet 10 to enable simple attachment and detachment of the battery connector to the battery terminal.

Figure 3:
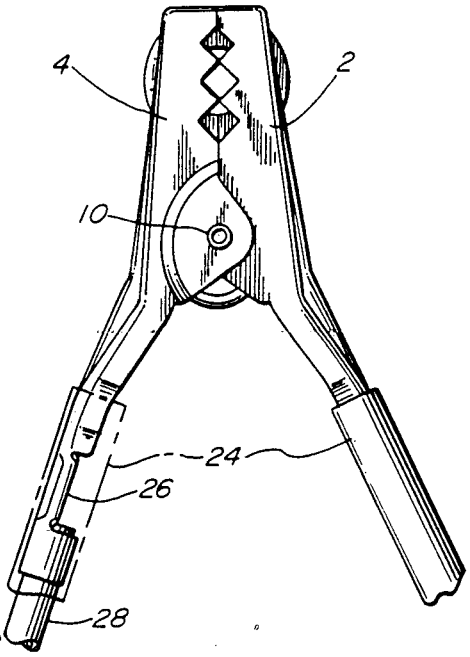
FIG. 3 is a bottom view of the battery cable connector having a plurality of teeth for connection to top mounted battery terminals.

FIG. 3 shows the bottom side of the connector leg in a reverse side of the battery connector. The battery connector is attached to the terminals in top terminal-type batteries using the set of teeth 18 formed on each of the two legs 2, 4. There is a set of serrated teeth on the bottom side of each leg to form a plurality of teeth 18. Again, the legs of the connector pivot around the rivet 10.

Figure 4:
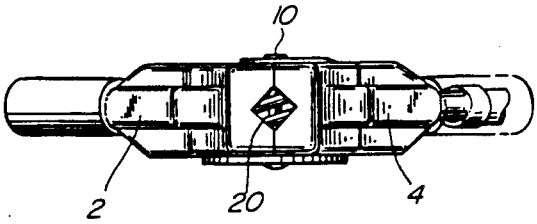
FIG. 4 shows a front view of the battery cable connector.

Automobile batteries sometimes are maintenance free. FIG. 4 shows a rectangular aperture 20 for attachment to small bolts on the frame of the vehicle. This will assist in grounding the negative cables when used with maintenance free batteries. The negative cable may also be grounded in this manner when used with batteries that are not maintenance free. Serrated teeth along the front edges could also be used, however, the preferred embodiment employs a rectangular aperture, or an aperture in the shape of a square for superior attachment capabilities.

Figure 5:
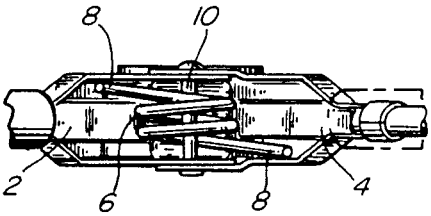
FIG. 5 shows a rear view of the battery cable connector showing the pivoting means and the spring biasing within the legs of the battery cable connector.

The preferred biasing is shown in FIG. 5. Here a spring 6 is used to force the front of the two legs 2, 4 of the connector together in the normal position. The force from the spring is applied to the legs of the connector through the two tangential extensions 8 at either end of the spring. The spring is mounted so that the rivet 10 passes through the coil of the spring. This arrangement will hold the spring in place and provide a means of pivoting for the legs, as well as a means of biasing the legs to hold them normally closed in a desired position. This arrangement also provides a spring force and a biasing means to enable attachment to terminals and bolts of all types, as discussed above.

Figure 6:
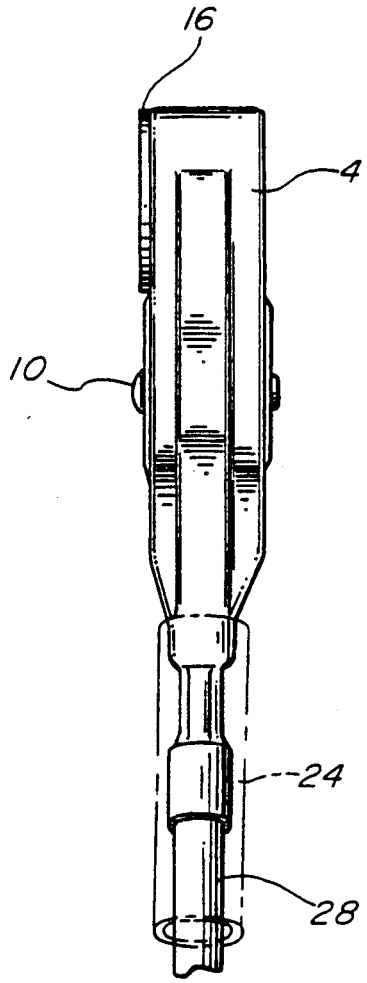
FIG. 6 shows a side view of one leg.
Figure 7:
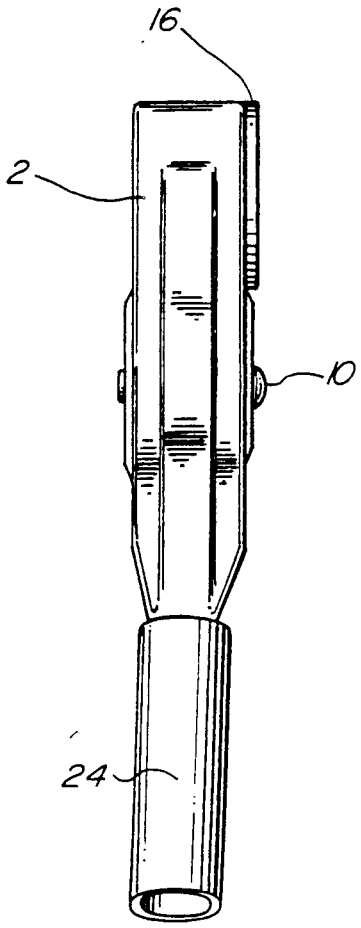
FIG. 7 shows a side view of another leg.

FIGS. 6 and 7 show the side views of the two legs 2, 4. The relative position of the annular ring 16 can be seen from either side. The legs are attached to cables 28, and insulating material 24 is placed on the connector legs from the tapering portion of the connector legs, over the portion of the connector that connects to the battery cable, to the cable itself. This provides the user with a manner of using the connector and not being shocked by the current that may flow through the cables.

Figure 8:
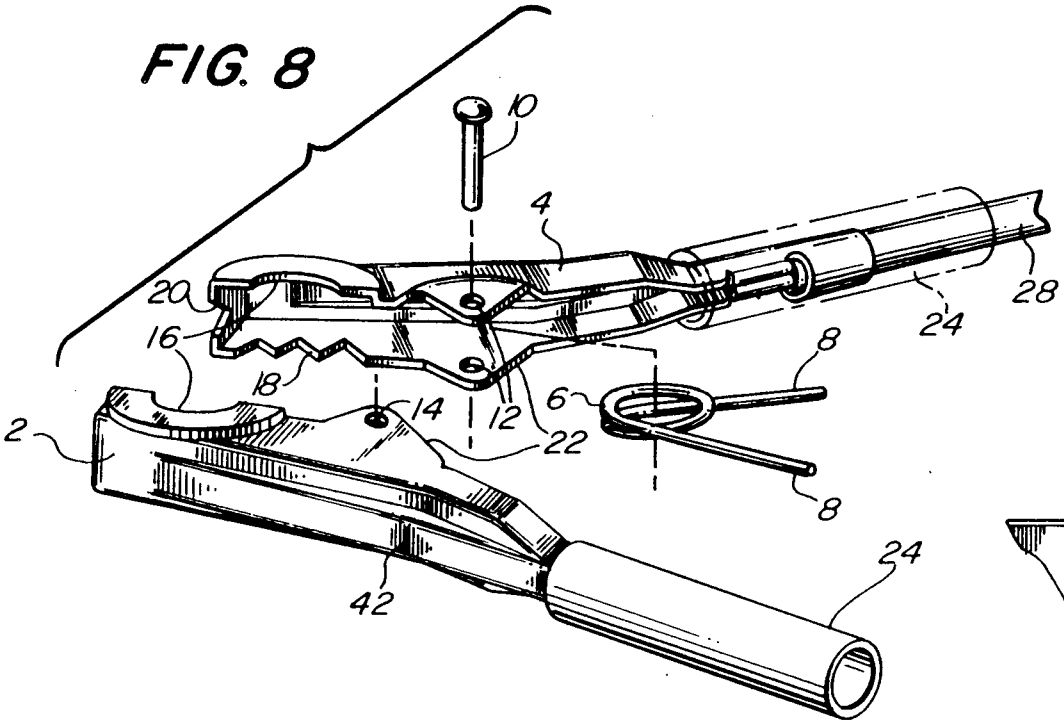
FIG. 8 shows a disassembled view of all the component parts of the invention.

FIG. 8 shows the preferred embodiment disassembled. As can be seen, each leg has a semicircular aperture in the form of a half annular ring 16 press stamped into the part at one end along a plurality of teeth 18 on the side of the leg immediately opposite the half annular ring. The middle side of each leg has ribbing reinforcement portions 42 on the side of the leg, giving the leg more strength and rigidity. The body of each leg consists of three sides that meet at essentially right angles to form a U-shape. Each leg appears to be the mirror image of the other, and this is true with the exception of the triangular protrusions 22. The triangular protrusions in one leg 4 overlap the triangular protrusions of the second leg. When the rivet 10 is passed through the holes 12 in the triangular protrusions, a hinge is formed. When the spring biasing 6 is inserted such that the center of the rivet passes through the coil of the spring, and the tangential extensions 8 of the spring rest against the insides of the legs, opposite the ends of the legs with apertures for mounting the connector onto terminals, then the connector will be normally closed at the end containing the apertures. The ends of the legs, opposite the ends containing the apertures, have the U-shaped taper down into the crimping connectors 26 stamp molded into the second ends of the legs to enable easy connection to battery cables 28. An insulator 24 then covers the tapering portion as well as the entire crimped portion of the connection, thus insulating the user from the possibility of electrical shock.

Figure 9:
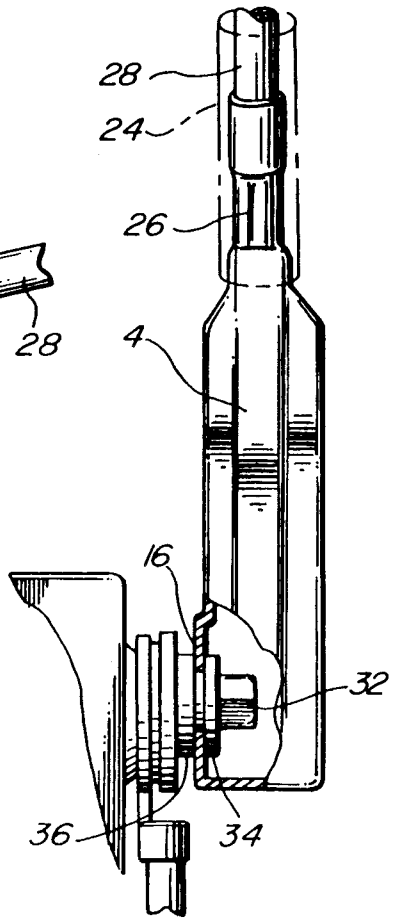
FIG. 9 shows a perspective view of the invention while engaged to the side terminal of a side battery terminal.

FIG. 9 shows the invention mounted on the terminal of a side terminal-type battery. The circular aperture 16 is attached around a conventional terminal assembly 32, which has an integral circular groove on a multistep flange section. This cutaway view shows the invention as being easily connected to the side mounted terminal batteries and securely fixed to the circular groove. There are no modifications to the connector required to enable its capability to connect to side mounted terminal batteries. Previous attempts to provide battery connectors that were capable of attachment to both side mounted or top mounted terminal batteries required some sort of modification to the connector to be able to attach to both top mounted terminal batteries or side mounted terminal batteries. The preferred embodiment clearly shows an invention that is capable of attachment to either battery type as simply as the conventional serrated tooth battery attaches to top mounted terminal batteries.

Those skilled in the art will appreciate that the just-described preferred embodiment is subject to numerous modifications and adaptations without departing from the scope and spirit of the invention Therefore, it is to be understood that, within the scope of the appended claims, the invention may be practiced other than as specifically described herein.

What is claimed is:

1. A battery cable connector capable of attachment to a side mounted terminal battery or a top mounted terminal battery, comprising:

a first leg and a second leg, each of said legs having a first end and a second end, and each of said legs being stamp molded from a rigid conductive material such that the legs are three-sided as well as U-shaped in cross section along their length;

a semicircular aperture at the first end of each of said legs surrounded by a semiannular ring extending from each leg and integrally stamp molded into each leg such that a circular aperture is formed when each of said first ends of said legs are placed together and the rings offset the remainder of the connector from the battery;

a plurality of teeth located at said first end of each of said legs opposite said semicircular aperture;

a pivoting means, said pivoting means consisting of a rivet;

a biasing means, said biasing means consisting of a spring through which said pivoting means will pass;

each of said legs having a pair of triangular protrusions near their center, said protrusions being directly opposite each other;

the molding of said protrusions being such that the protrusions of said first leg overlap the protrusions of said second leg;

a set of holes contained within said protrusions such that said pivoting means may pass through said holes and form a hinging mechanism with said biasing means forcing the first ends of said legs normally closed together, and means for connecting each of said legs to a cable at the second end of each of said legs, said means for connecting to a cable being a crimping mechanism.

2. A battery cable connector for attaching to terminals for either side mounted terminal batteries or top mounted terminal batteries, comprising:

a first leg and a second leg, said first and second legs being constructed from conductive materials, each leg including a top surface, a bottom surface, a side surface, the top surface and the bottom surface each being connected to the side surface at basically right angles thereto such that the top surface is parallel to and on top of the bottom surface, and a fourth surface which is in a plane that is perpendicular to each of the top, bottom, and side surfaces of that respective leg and contains an angular aperture;

a first end and a second end on each of said first and said second legs;

a pivoting means for joining said first leg and said second leg at a common point;

means for biasing the first end of the first leg and the first end of the second leg together;

means, in said first leg and in said second leg, for cooperatively forming a circular aperture capable of releasable attachment to a terminal on a side mounted terminal battery, wherein said means for releasable attachment comprises the first leg having a half-circular aperture therein near the first end, and the second leg having a half-circular aperture therein near the first end, the half-circular aperture being contained within the top surface of each of the first and second legs such that a circular opening is formed when the first leg and the second leg are biased together by the biasing means; and a plurality of teeth contained on the bottom surfaces of the first leg and the second leg near the first end of each of the first leg and the second leg, such that the plurality of teeth on the bottom surfaces of said first leg and said second leg are opposite the half-circular apertures contained within the top surface of that respective leg.

3. The connector of claim 2 wherein the second end of the first leg and the second end of the second leg each contain means for attaching to a cable.

4. The connector of claim 2, wherein the angular apertures on the fourth surfaces of the first leg and the second leg when biased together in the normal position form a geometric pattern.

5. The connector of claim 2 wherein the top surfaces and the bottom surfaces of each of the first leg and the second leg are a sufficient distance from each other to enable a nut, attached to the terminal of a side terminal battery, to fit between the top and bottom surfaces.

6. The connector of claim 2 wherein the first leg and the second leg have a cross-sectional U-shaped configuration.

7. The connector of claim 2 wherein the biasing means comprises a helical spring constructed with sufficient rigidity to keep the first and second legs normally biased together at the first end, said helical spring having sufficient resiliency to enable the opening and closing of the battery connector's first and second legs pivoting around said pivoting means.

8. The connector of claim 2 where the pivoting means consists of a rivet passing through holes in each of the first and second legs.

9. The connector of claim 2 where the pivoting means consists of a bolt passing through holes in each of the first and second legs.

10. The connector of claim 2, wherein said biasing means includes a set of tangential extensions at either end of the helical spring, said tangential extensions exerting forces on the first and second legs, respectively, to exert forces around the pivoting means and keep the first and second legs in a normally closed position.

11. The connector of claim 10 wherein the pivoting means includes shaping of the first and second legs to include means for attaching the first leg to the second leg at approximately the midpoint of the first and second legs.

12. A battery cable connector for attaching to terminals for either side mounted terminal batteries or top mounted terminal batteries, comprising:

a first leg and a second leg, said first and second legs being constructed from conductive materials, each leg including a top surface, a bottom surface, and a side surface the top surface and the bottom surface each being connected to the side surface at basically right angles thereto such that the top surface is parallel to and on top of the bottom surface;

a first end and a second end on each of said first and said second legs;

pivoting means for joining said first leg and said second leg at a common point;

biasing means including a spring having sufficient force to keep the first and second legs normally biased together at the first end, said spring having sufficient resiliency to enable the opening and closing of the battery connector's first and second legs pivoting around said pivoting means;

releasable attachment means, in said first leg and in said second leg, for cooperatively forming a circular aperture capable of releasable attachment to a terminal on a side mounted terminal battery, wherein said releasable attachment means comprises the first leg having a first half-circular aperture therein near its first end, and the second leg having a second half-circular aperture therein near its first end, the first and second half-circular apertures being contained within the top surfaces of the first and second legs respectively, such that a circular opening is formed when the first leg and the second leg are biased together by the biasing means, and a plurality of teeth contained on the bottom surfaces of the first leg and the second leg near the first end of each of the first leg and the second leg, such that the plurality of teeth on the bottom surfaces of said first leg and said second leg are opposite the half-circular aperture contained within the top surface of that respective leg.

13. A battery cable connector for attaching to terminals for either side mounted terminal batteries or top mounted terminal batteries, comprising:

a first leg and a second leg, said first and second legs being constructed from conductive materials, each leg including a top surface, a bottom surface, and a side surface, the top surface and the bottom surface each being connected to the side surface at basically right angles thereto such that the top surface is substantially parallel to and on top of the bottom surface;

a first end and a second end on each of said first and said second legs;

a pivoting means for joining said first leg and said second leg at a common point including holes in each leg and a connector member passing through the holes;

means for biasing the first end of the first leg and the first end of the second leg together;

means, in said first leg and in said second leg, for cooperatively forming a circular aperture capable of releasable attachment to a terminal on a side mounted terminal battery, wherein said means for releasable attachment comprises the first leg having a half-circular aperture therein near the first end, and the second leg having a half-circular opening therein near the first end, the half-circular aperture being contained within the top surface of each of the first and second legs such that a circular opening is formed when the first leg and the second leg are biased together by the biasing means; and a plurality of teeth contained on the bottom surfaces of the first leg and the second leg near the first end of each of the first leg and the second leg, such that the plurality of teeth on the bottom surfaces of said first leg and said second leg are opposite the half-circular aperture contained within the top surface of the respective leg.

14. A battery cable connector that is capable of attachment selectively to a top-mounted battery terminal or a side-mounted battery terminal, comprising:

first and second electrically conductive metal leg members having upper and lower conductive surfaces, said leg members being bent out of sheet metal;

means for pivotably connecting the leg members together to provide, on the side of a pivot point, respective handles configured to be held by an operator, and on the other side of the pivot point grasping sections configured on the leg member's upper and lower surfaces to permit attachment to a battery terminal, and means for biasing the grasping sections to a closed position adjacent each other, the upper surfaces of the first and second leg member grasping sections collectively forming a circular aperture of a dimension to grasp the side-mounted terminal in the closed position, the lower surfaces of the first and second leg member grasping sections having a plurality of teeth members of a complementary configuration for grasping the top-mounted terminal.

15. The connector of claim 14 wherein a half-annular ring is integrally provided on the upper surface of each leg member about the circular aperture to offset the circular aperture from the leg members.

16. The connector of claim 14 wherein an end face of each grasping section extends between the upper and lower surfaces, the respective end faces each having a complementary aperture of a dimension to grasp a bolt on a vehicle frame for grounding purposes.

17. The connector of claim 15 wherein an end face of each grasping section extends between the upper and lower surfaces, the respective end faces each having a complementary aperture of a dimension to grasp a bolt on a vehicle frame for grounding purposes.

* * * * *